US010697247B2

(12) United States Patent
Moss, Jr. et al.

(10) Patent No.: US 10,697,247 B2
(45) Date of Patent: Jun. 30, 2020

(54) ROTATABLE CUTTERS AND ELEMENTS FOR USE ON EARTH-BORING TOOLS IN SUBTERRANEAN BOREHOLES, EARTH-BORING TOOLS INCLUDING SAME, AND RELATED METHODS

(71) Applicant: Baker Hughes, a GE company, LLC, Houston, TX (US)

(72) Inventors: William A. Moss, Jr., Conroe, TX (US); Alexander Rodney Boehm, Wheat Ridge, CO (US); Jon David Schroder, The Woodlands, TX (US); Kegan L. Lovelace, Houston, TX (US); John Abhishek Raj Bomidi, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 215 days.

(21) Appl. No.: 15/662,626

(22) Filed: Jul. 28, 2017

(65) Prior Publication Data

US 2019/0032410 A1 Jan. 31, 2019

(51) Int. Cl.

| | |
|---|---|
| ***E21B 10/55*** | (2006.01) |
| ***E21B 10/62*** | (2006.01) |
| ***E21B 10/32*** | (2006.01) |
| ***E21B 10/54*** | (2006.01) |
| ***E21B 10/573*** | (2006.01) |
| *E21B 10/42* | (2006.01) |

(52) U.S. Cl.

CPC ..... *E21B 10/325* (2013.01); *E21B 10/54* (2013.01); *E21B 10/55* (2013.01); *E21B 10/573* (2013.01); *E21B 10/62* (2013.01); *E21B 2010/425* (2013.01)

(58) Field of Classification Search

CPC ..... E21B 10/55; E21B 10/564; E21B 10/567; E21B 10/573; E21B 10/627; E21B 10/633; E21B 2010/545; E21B 10/561

See application file for complete search history.

(56) References Cited

U.S. PATENT DOCUMENTS 3,945,681 A * 3/1976 White ..... E21C 35/19 299/107
4,542,942 A 9/1985 Zitz et al.
4,553,615 A 11/1985 Grainger
(Continued)

FOREIGN PATENT DOCUMENTS

EP 2143872 A1 1/2010
GB 2541812 A 3/2017
(Continued)

OTHER PUBLICATIONS

International Written Opinion for International Application No. PCT/US2018/043613 dated Oct. 31, 2018, 11 pages.
(Continued)

*Primary Examiner* — Kenneth L Thompson
(74) *Attorney, Agent, or Firm* — TraskBritt

(57) ABSTRACT

Rotatable elements for use with earth-boring tools include a movable element and a stationary element. The movable element and stationary element include an index positioning feature that is configured to rotate the movable element as the movable element moves between a first axial position and a second axial position.

20 Claims, 6 Drawing Sheets

(56) References Cited

U.S. PATENT DOCUMENTS

| | | | |
|---|---|---|---|
| 4,654,947 | A | 4/1987 | Davis |
| 4,751,972 | A | 6/1988 | Jones et al. |
| 7,604,073 | B2 | 10/2009 | Cooley et al. |
| 7,703,559 | B2 | 4/2010 | Shen et al. |
| 7,762,359 | B1 | 7/2010 | Miess |
| 7,845,436 | B2 | 12/2010 | Cooley et al. |
| 7,987,931 | B2 | 8/2011 | Cooley et al. |
| 8,061,452 | B2 | 11/2011 | Cooley et al. |
| 8,079,431 | B1 | 12/2011 | Cooley et al. |
| 8,091,655 | B2 | 1/2012 | Shen et al. |
| 8,210,285 | B2 | 7/2012 | Cooley et al. |
| 8,413,746 | B2 | 4/2013 | Shen et al. |
| 8,561,728 | B2 | 10/2013 | Cooley et al. |
| 8,590,627 | B2 | 11/2013 | Jin et al. |
| 8,800,691 | B2 | 8/2014 | Shen et al. |
| 8,881,849 | B2 | 11/2014 | Shen et al. |
| 8,931,582 | B2 | 1/2015 | Cooley et al. |
| 8,950,516 | B2 | 2/2015 | Newman |
| 8,973,684 | B1 | 3/2015 | Cooley et al. |
| 8,991,523 | B2 | 3/2015 | Shen et al. |
| 9,016,409 | B2 | 4/2015 | Zhang et al. |
| 9,033,070 | B2 | 5/2015 | Shen et al. |
| 9,091,132 | B1 | 7/2015 | Cooley et al. |
| 9,187,962 | B2 | 11/2015 | Burhan et al. |
| 9,279,294 | B1 | 3/2016 | Cooley et al. |
| 9,284,790 | B2 | 3/2016 | Zhang et al. |
| 9,291,000 | B2 | 3/2016 | Zhang et al. |
| 9,322,219 | B2 | 4/2016 | Burhan et al. |
| 9,328,564 | B2 | 5/2016 | Zhang et al. |
| 9,382,762 | B2 | 7/2016 | Cooley et al. |
| 9,388,639 | B2 | 7/2016 | Patel et al. |
| 9,464,486 | B2 | 10/2016 | Zhang et al. |
| 9,605,486 | B2 | 3/2017 | Burhan et al. |
| 9,624,731 | B2 | 4/2017 | Haugvaldstad et al. |
| 9,803,427 | B1 | 10/2017 | Colley et al. |
| 9,920,579 | B2 | 3/2018 | Newman |
| 10,267,096 | B2 | 4/2019 | Burhan et al. |
| 2007/0137899 | A1 | 6/2007 | Beccu |
| 2008/0035386 | A1 | 2/2008 | Hall et al. |
| 2008/0251293 | A1 | 10/2008 | Mumma et al. |
| 2010/0314176 | A1 | 12/2010 | Zhang et al. |
| 2011/0017514 | A1 | 1/2011 | Anderele |
| 2012/0234609 | A1 | 9/2012 | Cooley et al. |
| 2012/0273281 | A1 | 11/2012 | Burhan et al. |
| 2012/0318580 | A1 | 12/2012 | Oesterberg |
| 2013/0098688 | A1 | 4/2013 | Yong et al. |
| 2014/0054094 | A1 | 2/2014 | Burhan et al. |
| 2014/0131118 | A1 | 5/2014 | Chen et al. |
| 2014/0246246 | A1 | 9/2014 | Radford |
| 2014/0271008 | A1 | 9/2014 | Sweetman et al. |
| 2014/0326515 | A1 | 11/2014 | Shi et al. |
| 2014/0326516 | A1 | 11/2014 | Haugvaldstad et al. |
| 2014/0345951 | A1 | 11/2014 | Shen et al. |
| 2014/0360789 | A1 | 12/2014 | Siracki et al. |
| 2014/0360792 | A1 | 12/2014 | Azar et al. |
| 2015/0047910 | A1 | 2/2015 | Chen et al. |
| 2015/0129310 | A1 | 5/2015 | Newman |
| 2015/0266088 | A1 | 9/2015 | Shimizu et al. |
| 2016/0290056 | A1 | 10/2016 | Propes et al. |
| 2017/0036269 | A1 | 2/2017 | Lim et al. |
| 2017/0100756 | A1 | 4/2017 | Hewitt |
| 2017/0191317 | A1 | 7/2017 | Burhan et al. |
| 2019/0078393 | A1* | 3/2019 | Moss, Jr. ..... E21B 10/573 |

FOREIGN PATENT DOCUMENTS

| | | | |
|---|---|---|---|
| WO | 2012/1149120 | A2 | 11/2012 |
| WO | 2014/1078683 | A1 | 5/2014 |
| WO | 2015/023953 | A1 | 2/2015 |
| WO | 2016/1018204 | A1 | 2/2016 |

OTHER PUBLICATIONS

International Search Report for International Application No. PCT/US2018/043613 dated Oct. 31, 2018, 3 pages.

Moss et al., U.S. Appl. No. 15/704,955, filed Sep. 14, 2017 and titled Earth-Boring Tools Including Rotatable Cutting Element Assemblies and Related Methods of Forming and Using the Same.

Schroder et al., U.S. Appl. No. 15/810,412, filed Nov. 13, 2017 and titled Methods of Forming Stationary Elements of Rotatable Cutting Elements for Use on Earth-Boring Tools and Stationary Elements Formed Using Such Methods.

Schroder et al., U.S. Appl. No. 15/662,647, filed Jul. 28, 2017 and titled Moveable Cutters and Devices Including One or More Seals for Use on Earth-Boring Tools in Subterranean Boreholes and Related Methods.

* cited by examiner

ROTATABLE CUTTERS AND ELEMENTS FOR USE ON EARTH-BORING TOOLS IN SUBTERRANEAN BOREHOLES, EARTH-BORING TOOLS INCLUDING SAME, AND RELATED METHODS

TECHNICAL FIELD

Embodiments of the present disclosure generally relate to devices and methods involving cutting and other rotatable elements for earth-boring tools used in earth boring operations and, more specifically, to cutting elements for earth-boring tools that may rotate in order to alter the rotational positioning of the cutting edge and cutting face of the cutting element relative to an earth-boring tool to which the cutting element is coupled, to earth-boring tools so equipped, and to related methods.

BACKGROUND

Various earth-boring tools such as rotary drill bits (including roller cone bits and fixed-cutter or drag bits), core bits, eccentric bits, bi-center bits, reamers, and mills are commonly used in forming boreholes or wells in earth formations. Such tools often may include one or more cutting elements on a formation-engaging surface thereof for removing formation material as the earth-boring tool is rotated or otherwise moved within the borehole.

For example, fixed-cutter bits (often referred to as "drag" bits) have a plurality of cutting elements affixed or otherwise secured to a face (i.e., a formation-engaging surface) of a bit body. Cutting elements generally include a cutting surface, where the cutting surface is usually formed out of a superabrasive material, such as mutually bound particles of polycrystalline diamond. The cutting surface is generally formed on and bonded to a supporting substrate of a hard material such as cemented tungsten carbide. During a drilling operation, a portion of a cutting edge, which is at least partially defined by the peripheral portion of the cutting surface, is pressed into the formation. As the earth-boring tool moves relative to the formation, the cutting element is dragged across the surface of the formation and the cutting edge of the cutting surface shears away formation material. Such cutting elements are often referred to as "polycrystalline diamond compact" (PDC) cutting elements, or cutters.

During drilling, cutting elements are subjected to high temperatures due to friction between the cutting surface and the formation being cut, high axial loads from the weight on bit (WOB), and high impact forces attributable to variations in WOB, formation irregularities and material differences, and vibration. These conditions can result in damage to the cutting surface (e.g., chipping, spalling). Such damage often occurs at or near the cutting edge of the cutting surface and is caused, at least in part, by the high impact forces that occur during drilling. Damage to the cutting element results in decreased cutting efficiency of the cutting element. When the efficiency of the cutting element decreases to a critical level the operation must be stopped to remove and replace the drill bit or damaged cutters, which is a large expense for an operation utilizing earth-boring tools.

Securing a PDC cutting element to a drill bit restricts the useful life of such cutting element, as the cutting edge of the diamond table wears down as does the substrate, creating a so-called "wear flat" and necessitating increased weight on bit to maintain a given rate of penetration of the drill bit into the formation due to the increased surface area presented. In addition, unless the cutting element is heated to remove it from the bit and then rebrazed with an unworn portion of the cutting edge presented for engaging a formation, more than half of the cutting element is never used.

Attempts have been made to configure cutting elements to rotate such that the entire cutting edge extending around each cutting element may selectively engage with and remove material. By utilizing the entire cutting edge, the effective life of the cutting element may be increased. Some designs for rotating cutting elements allow the cutting element to freely rotate even when under a cutting load. Rotating under a load results in wear on internal surfaces, exposing the cutting element to vibration, which can damage the cutting elements reducing their life, and may result in uneven wear on the cutting edge of the cutting element.

BRIEF SUMMARY

In some embodiments, the present disclosure includes a rotatable cutter for use on an earth-boring tool in a subterranean borehole. The rotatable cutter may comprise a rotatable element and a stationary element. The rotatable element may comprise a cutting surface and a support structure for the cutting surface. The stationary element may comprise a cavity wherein the rotatable element may be at least partially disposed and an index positioning feature. The rotatable element may move relative to the stationary element along a longitudinal axis of the rotatable cutter. The index positioning feature may comprise at least one track and at least one protrusion. The protrusion and track may engage each other to rotate the rotatable element as the rotatable element travels between a first axial position and a second axial position.

In additional embodiments, the present disclosure includes an earth-boring tool comprising a tool body and elements carried by the tool body. At least one element of the elements comprises a movable element, a sleeve, and an index positioning feature. The movable element may comprise a surface for engaging a portion of the subterranean borehole. The movable element may be coupled to the sleeve and configured to move along the longitudinal axis of the rotatable element between a first axial position and a second axial position. The index positioning feature may be configured to rotate the movable element as the movable element moves between the first axial position and the second axial position.

Further embodiments of the present disclosure include a method for rotating the cutting element. The cutting element may be rotated by translating an inner cutting element along the longitudinal axis of the cutting element with respect to an outer sleeve. An index positioning feature may be used to rotate the inner cutting element as the inner cutting element is translated between the first axial position and the second axial position. The index positioning feature may also, at least partially, impede the rotation of the inner cutting element when the inner cutting element is in, at least one of, the first axial position or the second axial position.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular earth-boring tool, rotatable cutting element or component thereof, but are merely idealized representations employed to describe illustrative embodiments. The drawings are not necessarily to scale.

Disclosed embodiments relate generally to rotatable elements (e.g., cutting elements) for earth-boring tools that may rotate in order to alter the positioning of the cutting element relative to an earth-boring tool to which the cutting element is coupled. For example, such a configuration may enable the cutting element to present a continuously sharp cutting edge with which to engage an earth formation while still occupying substantially the same amount of space as conventional fixed cutting elements. Some embodiments of such rotatable cutting elements may include a stationary element and a rotatable element with an index positioning feature. The index positioning feature may act to rotate and/or control rotation of the cutting element. In some embodiments, the index positioning feature may act to enable rotation of the cutting element when the cutting element is not actively engaged in removing material, while stopping rotation of the cutting element when the cutting element is actively engaged in removing material.

Such rotatable elements may be implemented in a variety of earth-boring tools, such as, for example, rotary drill bits, percussion bits, core bits, eccentric bits, bi-center bits, reamers, expandable reamers, mills, drag bits, roller cone bits, hybrid bits, and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Figure 1:
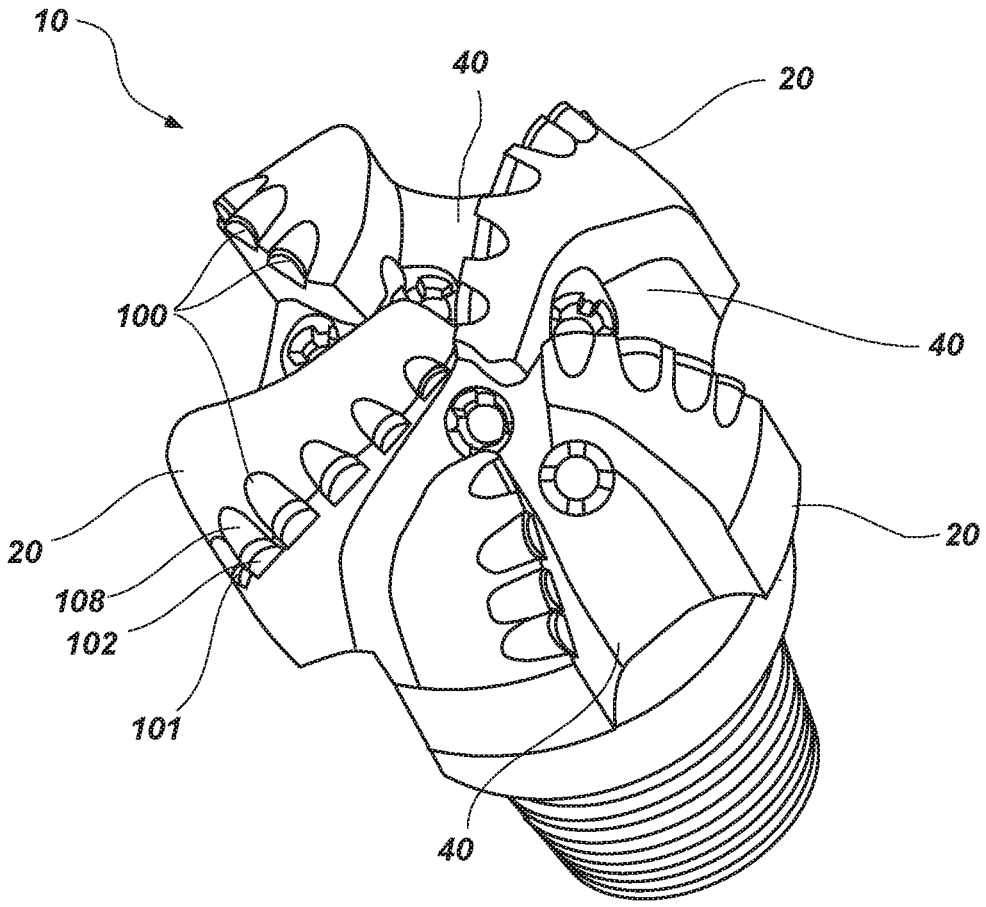
FIG. 1 illustrates a fixed-cutter earth-boring tool commonly known as a "drag-bit," in accordance with embodiments of the present disclosure.

Referring to FIG. 1, a perspective view of an earth-boring tool 10 is shown. The earth-boring tool 10 may have blades 20 in which a plurality of cutting elements 100 may be secured. The cutting elements 100 may have a cutting table 101 with a cutting surface 102, which may form the cutting edge of the blade 20. The earth-boring tool 10 may rotate about a longitudinal axis of the earth-boring tool 10. When the earth-boring tool 10 rotates, the cutting surface 102 of the cutting elements 100 may contact the earth formation and remove material. The material removed by the cutting surfaces 102 may then be removed through the junk slots 40. The earth-boring tool 10 may include nozzles which may introduce drilling fluid, commonly known as drilling mud, into the area around the blades 20 to aid in removing the sheared material and other debris from the area around the blades 20 to increase the efficiency of the earth-boring tool 10.

In applications where the cutting elements 100 are fixed, only the edge of the cutting surface 102 of the cutting elements 100 that is exposed above the surface of the blade 20 will contact the earth formation and wear down during use. By rotating the cutting element 100, relatively more of (e.g., a majority of, a substantial entirety of) the edge of the cutting surface 102 may be exposed to wear and may act to extend the life of the cutting element 100. Additional control over the frequency of the rotation, as well as the amount of rotation, may further extend the life of the cutting element 100.

Figure 2:
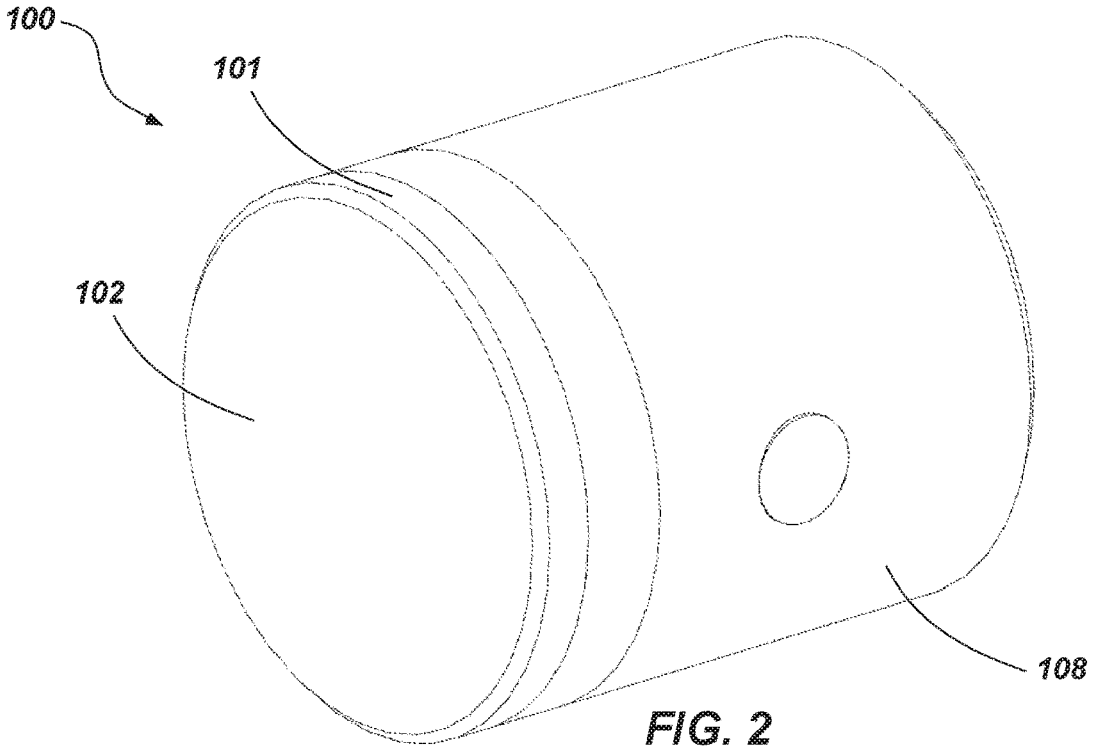
FIG. 2 is an isometric view of a rotatable cutter in accordance with an embodiment of the present disclosure.

Referring to FIG. 2, a perspective view of an embodiment of a rotatable cutting element 100 is shown. The rotatable cutting element 100 may comprise the cutting table 101 with the cutting surface 102 and a substrate 108. The cutting table 101 may be formed from a polycrystalline material, such as, for example, polycrystalline diamond or polycrystalline cubic boron nitride. The rotatable cutting element 100 may be secured to the earth-boring tool 10 (FIG. 1) by fixing an exterior surface of the substrate 108 to the earth-boring tool 10. This is commonly achieved through a brazing process.

Figure 3A:
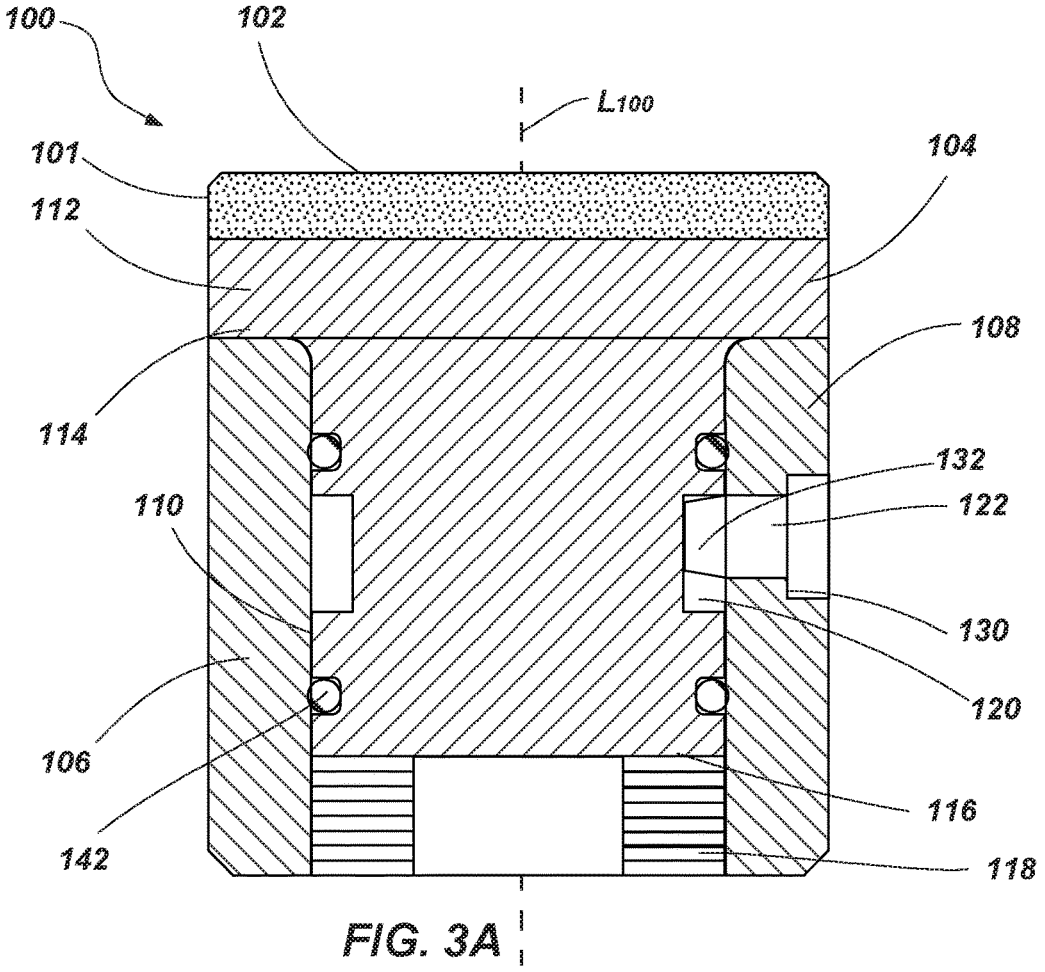
FIG. 3A is a cross-sectional side view of a rotatable cutter in a first position in accordance with embodiments of the present disclosure.

Referring to FIG. 3A, a cross-sectional side view of an embodiment of the rotatable cutting element 100 in a compressed position is shown. To enable the cutting surface 102 to rotate, the substrate 108 of the rotatable cutting element 100 may be separated into multiple parts, for example, an inner cutting element (e.g., a rotatable element 104) and an outer element (e.g., a stationary element 106 or sleeve). The stationary element 106 may define the exterior surface of the substrate 108. A cavity 110 in the stationary element 106 may receive the rotatable element 104. For example, the rotatable element 104 may be disposed at least partially within the cavity 110. The substrate 108, or portions thereof (e.g., the rotatable element 104 and/or stationary element 106), may be formed from a hard material suitable for use in a borehole, such as, for example, a metal, an alloy (e.g., steel), ceramic-metal composite material (e.g., cobalt-cemented tungsten carbide), or combinations thereof.

Figure 3B:
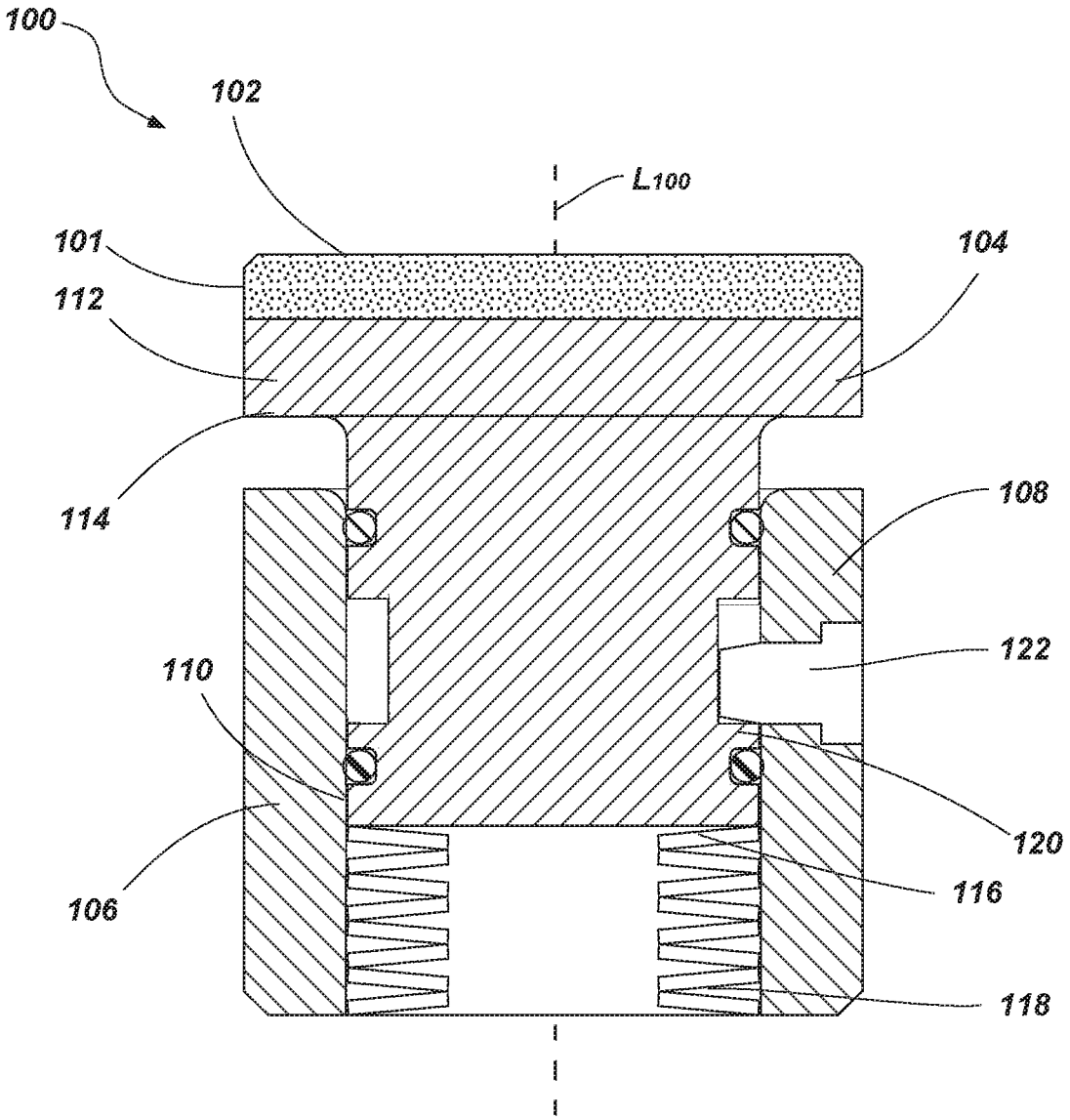
FIG. 3B is a cross-sectional side view of a rotatable cutter in a second position in accordance with embodiments of the present disclosure.

The rotatable element 104 may be configured to rotate about and move along the longitudinal axis $L_{100}$ of the rotatable cutting element 100 relative to the stationary element 106. The rotatable cutting element 100 may rotate the rotatable element 104 by translating the rotatable element 104 between a first axial position along the longitudinal axis $L_{100}$ (e.g., a compressed position as shown in FIG. 3A) and a second axial position along the longitudinal axis $L_{100}$ (e.g., an expanded position as shown in FIG. 3B) with an index positioning feature 120. The index positioning feature 120 may be used for rotating the rotatable element 104 as the rotatable element 104 is translated between the first axial position and the second axial position through interaction of components of the index positioning feature 120 during such axial movement, as discussed below in greater detail.

The rotatable element 104 may comprise a cutting surface 102 over a support structure 112. In some embodiments, the rotatable element 104 may be sized and configured such that the cutting table 101 is at least the same diameter as the stationary element 106. For example, a shoulder 114 may rest against the stationary element 106 to support the cutting table 101, for example, when the cutting surface 102 is engaged in removing material. The lower portion of the support structure 112 may be of a smaller diameter to facilitate being at least partially disposed within the stationary element 106. The support structure 112 of the rotatable element 104 may have a base 116 opposite the cutting surface 102. A motivating element 118 may be interposed between the stationary element 106 and the rotatable element 104 (e.g., positioned within an internal portion of the cavity 110). The motivating element 118 may be configured to act on the base 116, to move (e.g., translate, slide) the rotatable element 104 longitudinally along the longitudinal axis $L_{100}$ of the rotatable cutting element 100 between the first axial position and the second axial position.

In some embodiments, the motivating element 118 may comprise a biasing element. The biasing element may be configured to bias the rotatable element 104 in the first axial position in a direction away from the stationary element 106. Examples of biasing elements that may be used, by way of example but not limitation, are springs, washers (e.g., Bellville washers), compressible fluids, magnetic biasing, resilient materials, or combinations thereof.

An index positioning feature 120 may be positioned between (e.g., laterally between) the rotatable element 104 and the stationary element 106. The index positioning feature 120 may enable the rotatable element 104 to move along the longitudinal axis $L_{100}$ between the first compressed axial position and the expanded second axial position and prevent the rotatable element 104 from moving beyond one or more of the first axial position and the second axial position (e.g., beyond the expanded position). When the cutting surface 102 is engaged with another structure (e.g., a portion of an earth formation), the rotatable element 104 may be in the first compressed axial position. When the cutting surface 102 is disengaged from the structure, the force (e.g., the constant force that is overcome by engagement of the rotatable element 104 with the formation) applied by the motivating element 118 on the base 116 may move the rotatable element 104 from the first axial position to the second axial position.

In some embodiments, when the rotatable element 104 is in one or more of the first axial position and the second axial position (e.g., both positions), the index positioning feature 120 may act to at least partially prevent rotation of the rotatable element 104. For example, the index positioning feature 120 may act to substantially secure the rotatable element 104 when the rotatable element 104 is in one or more of the first axial position and the second axial position to inhibit substantial rotation of the rotatable element 104.

In some embodiments, some of the features may be coated with wear resistant and/or low friction coatings. Features, such as, for example, the shoulder 114, the stationary element 106, the rotatable element 104 and the indexing feature 120 may benefit from different coatings. The coatings may include low friction coatings and/or wear resistant coatings capable of withstanding downhole conditions, such as, by way of example but not limitation, Diamond-like Carbon (DLC), soft metals (e.g., materials having relatively lower hardness, copper), dry lube films, etc. The coatings may be positioned on the interface surfaces between one or more of the features where there may be a high potential for increased wear. In some embodiments, different coatings may be used on different surfaces within the same rotatable cutting element 100, as different coatings may have additional benefits when applied to different surfaces. For example, the interface between the shoulder 114 and the stationary element 106 may be coated with a relatively soft metal while the index positioning feature 120 may be coated with a DLC coating. Additional examples may include any variations of low friction or wear resistant materials.

In some embodiments, the rotatable cutting element 100 may include one or more seals 142 configured to the form a seal between the rotatable element 104 and the stationary element 106 to prevent drilling mud and formation debris from stalling rotation of the rotatable element 104.

Referring to FIG. 3B, a cross-sectional side view of an embodiment of the rotatable cutting element 100 in an expanded position is shown. As depicted, when the cutting surface 102 is disengaged from a structure, the motivating element 118 may act on the base 116 to move the rotatable element 104 relative to the stationary element 106 to the second axial position (e.g., expanded position). As the rotatable element 104 moves a separation may be introduced between the shoulder 114 and the stationary element 106. The pin 122 may interact with the index positioning feature 120 to prevent the rotatable element 104 from moving beyond the second axial position.

Figure 4:
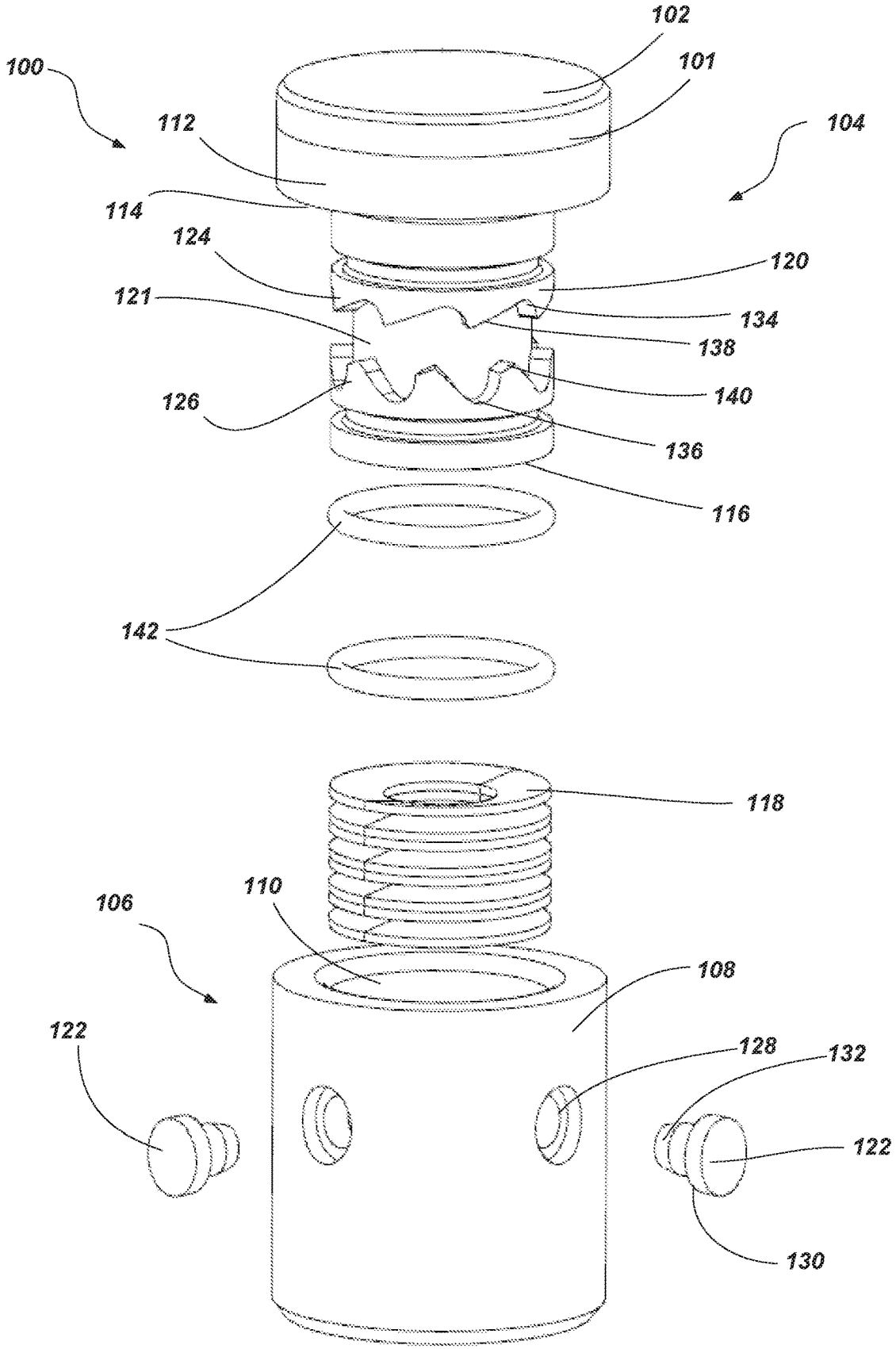
FIG. 4 is an exploded view of a rotatable cutter in accordance with embodiments of the present disclosure.

FIG. 4 is an exploded view of the embodiment shown in FIGS. 3A and 3B. Referring to FIGS. 3A, 3B, and 4, the index positioning feature 120 may comprise one or more protrusions (e.g., pin 122) and one or more tracks 121. For example, the track 121 may be defined in the rotatable element 104 by one or more track portions 124, 126 (e.g., undulating upper and lower track portions 124, 126 including protrusions and recesses positioned on each longitudinal side of the track 121). The engagement of the pins 122 in the track 121 may be configured to rotate the rotatable element 104 relative to the stationary element 106 when the rotatable element 104 is moved toward the second axial position or toward the first axial position. As depicted, the offset peaks and valleys in each track portion 124, 126 enable the pins 122, in conjunction with the forced axial movement of the rotatable element 104 (e.g., due to external forces and/or the force of the motivating element 118), to slide on one of the track portions 124, 126 in order to rotate the rotatable element 104. In some embodiments, the pins 122 may be positioned on the stationary element 106 and the track 121 may be defined on the support structure 112 of the rotatable element 104. In some of these embodiments, the pins 122 may comprise at least two pins 122 arranged about (e.g., around) the longitudinal axis $L_{100}$. As depicted, the track 121 may be recessed into a portion of the rotatable element 104 as shown in FIG. 4. In some embodiments, the track 121 may protrude from the rotatable element 104 with pins 122 following outer surfaces of the track 121.

As depicted, the pins 122 may be at least partially disposed within the stationary element 106. The stationary element 106 may have pin passages 128 to facilitate assembly. For example, the pins 122 may be at least partially (e.g., entirely) removed in order to provide clearance for the rotatable element 104 to be inserted into and removed from the stationary element 106. The pins 122 may be inserted through the pin passages 128 in the stationary element 106 and secured to the stationary element 106. The pins 122 may have a pin shoulder 130 to maintain the pins 122 within the stationary element 106 with a pin tip 132 entering the cavity 110 to engage the track 121 on the rotatable element 104.

The track 121 may be used to control the rotational motion of the rotatable element 104. In some embodiments, the track 121 may be disposed within the support structure 112 of the rotatable element 104. The track 121 may be configured to substantially inhibit rotation of the rotatable element 104 when the rotatable element 104 is in at least one of the first axial position or the second axial position. In some embodiments, the track 121 may be configured to at least partially inhibit rotation of the rotatable element 104 when the rotatable element 104 is in both the first axial position and the second axial position. As shown in the embodiment of FIG. 4, one of the track portions (e.g., track portion 124 positioned in an upper position relatively closer to the cutting surface 102) may include a top track detent 134 that may arrest the pin 122 inhibiting the rotation of the rotatable element 104 when the rotatable element 104 is in the first axial position. Another one of the track portions (e.g., track portion 126 positioned in a lower position relatively further away from the cutting surface 102) may include a bottom track detent 136, which may act in a similar fashion to the top track detent 134 when the rotatable element 104 is in the second axial position.

The interaction between the pins 122 and the track 121 may be configured to impart rotation on the rotatable element 104 when the rotatable element 104 moves between the first axial position and the second axial position. For example, the pin 122 may engage the upper track portion 124 when the rotatable element 104 moves from the second axial position to the first axial position. The pattern in the upper track portion 124 may include a top track ramp 138. The pin 122 may engage the top track ramp 138 when moving from the second axial position to the first axial position (e.g., a compressed position as shown in FIG. 3A). The top track ramp 138 may impart rotation on the rotatable element 104 as the pin 122 acts on and travels along the top track ramp 138. The pin 122 may engage the lower track portion 126 when the rotatable element 104 travels from the first axial position to the second axial position (e.g., an expanded position as shown in FIG. 3B). For example, the lower track portion 126 may include a bottom track ramp 140, which may act in a similar fashion to the top track ramp 138 as the rotatable element 104 travels from the first axial position to the second axial position.

The spacing of the top and bottom track detents 134 and 136, and ramps 138 and 140 may be configured to incrementally rotate the cutting surface 102 of the rotatable cutting element 100 relative to an earth-boring tool 10 on which the rotatable cutting element 100 is attached. Incrementally rotating the rotatable cutting element 100 may result in the ability to incrementally present portions of the cutting table 101 in a position relative to the formation. Such incremental rotation may result in enabling the cutting table 101 to selectively wear numerous portions of the cutting table 101 around the circumference of the cutting surface 102, which may extend the life of the rotatable cutting element 100. Incrementally rotating the rotatable cutting element 100 may also give the operator greater control over the frequency of the rotation.

In some embodiments, the top and bottom track detents 134 and 136, respectively, may act to secure the rotatable element 104 when the rotatable element 104 is in one or more of the first axial position and the second axial position to at least partially prevent rotation of the rotatable element 104.

The top and bottom track detents 134 and 136, respectively, may have varying degrees of separation in different embodiments to provide a selected amount of radial positions for the rotatable element 104. For example, there may be eight evenly spaced top track detents 134 and eight evenly spaced bottom track detents 136. The eight detents may be spaced at 45 degree intervals. In an embodiment with eight detents, the rotatable element 104 may incrementally rotate 45 degrees each time. In another embodiment, there may be two top track detents 134 and two bottom track detents 136 evenly spaced at 180 degree intervals. In an embodiment with two detents, the rotatable element 104 may incrementally rotate 180 degrees each time. Other embodiments may have detents that are not evenly spaced. For example, an embodiment may have four detents each placed at different degree intervals, or placed in pairs with a smaller interval such as 45 degrees separating two of the detents and a larger interval such as 135 degrees separating the two pairs. There may be many other combinations of numbers of detents and degrees of separation that may be used in other embodiments.

In some embodiments, the index positioning feature 120 may rotate the rotatable element 104 one part (e.g., portion, fraction) of an incremental rotation (e.g., half, 60%, 70%) when the rotatable element 104 is moved toward the first axial position and another part of the incremental rotation (e.g., the other half, 40%, 30%) when the rotatable element 104 is moved toward the second axial position. For example, the top and bottom track detents 134 and 136 and ramps 138 and 140 may be offset from one another as shown in FIG. 4. As the rotatable element 104 travels from the first axial position to the second axial position, the top track ramp 138 may act on the rotatable element 104 through the pin 122 to rotate the rotatable element 104 through a portion of the incremental rotation until the pin 122 reaches the top track detent 134 stopping the rotation. As the rotatable element 104 travels in the opposite direction from the second axial position to the first axial position, the bottom track ramp 140 may act on the rotatable element 104 through the pin 122 to complete the incremental rotation. In some embodiments, the ramps 138 and 140 may have different slopes. The different slopes may enable the rotatable element 104 to rotate through a smaller part of the rotation (e.g., less than 50%, 40%, 30%, or less) when the rotatable element 104 travels from the first axial position to the second axial position by engaging a steeper slope. Likewise, the different slopes may enable the rotatable element 104 to rotate through a larger part of the rotation (e.g., more than 50%, 60%, 70%, or greater) when the rotatable element 104 travels from the second axial position to the first axial position by engaging a shallower slope. In other embodiments, the slopes may be different to allow the rotatable element 104 to rotate through a larger portion of the rotation when the rotatable element 104 travels from the first axial position to the second axial position. The increment of the rotation may be determined by the degrees of separation of the top and bottom track detents 134 and 136 as discussed above.

Figure 5:
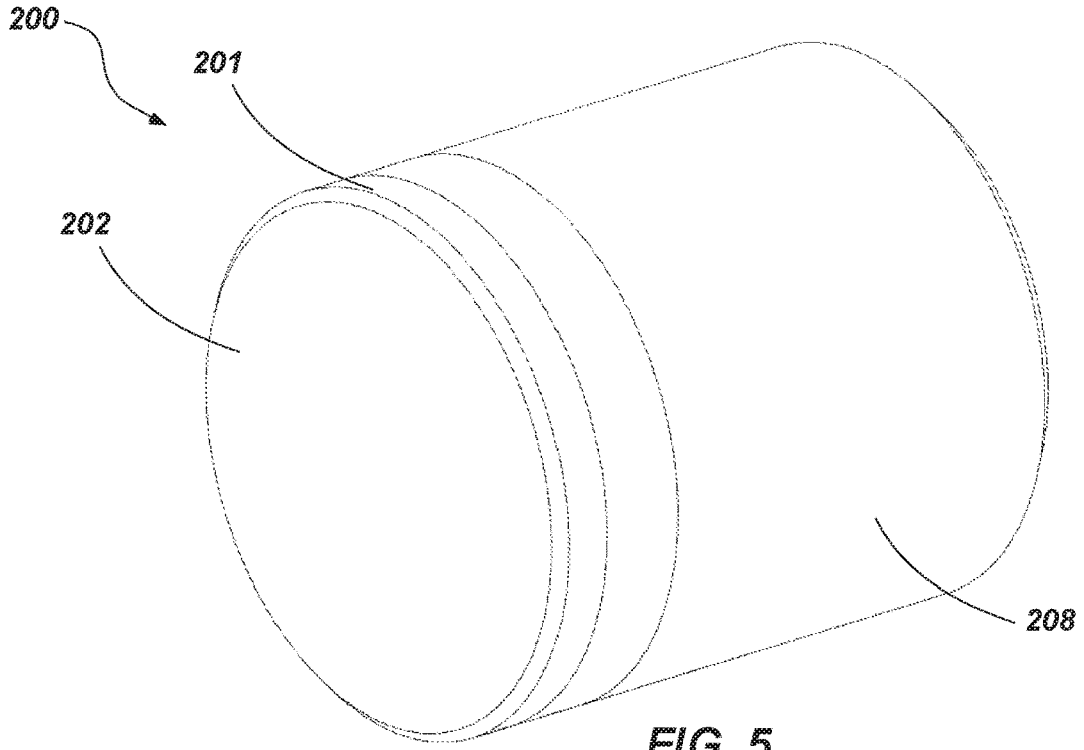
FIG. 5 is an isometric view of a rotatable cutter in accordance with another embodiment of the present disclosure.

Referring to FIG. 5, a perspective view of an additional embodiment of a rotatable cutter 200 is shown. An exterior of the rotatable cutter 200 may be somewhat similar to embodiment of the rotatable cutting element 100 shown and described in FIGS. 2 through 4. The rotatable cutter 200 may include a cutting table 201 a cutting surface 202 and a substrate 208. The rotatable cutter 200 may be secured to the earth-boring tool 10 by fixing an exterior surface of the substrate 208 to the earth-boring tool 10.

Figure 6:
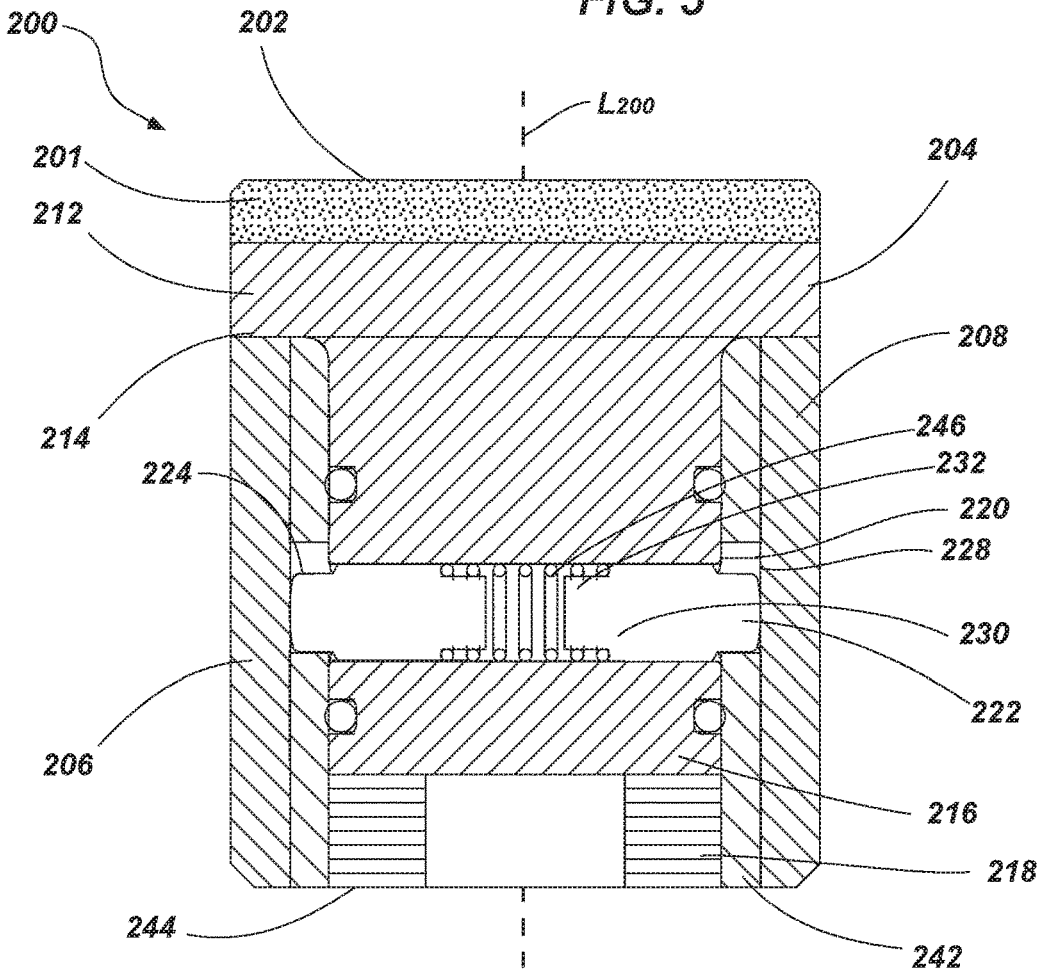
FIG. 6 is a cross-sectional side view of the rotatable cutter shown in FIG. 5.
Figure 7:
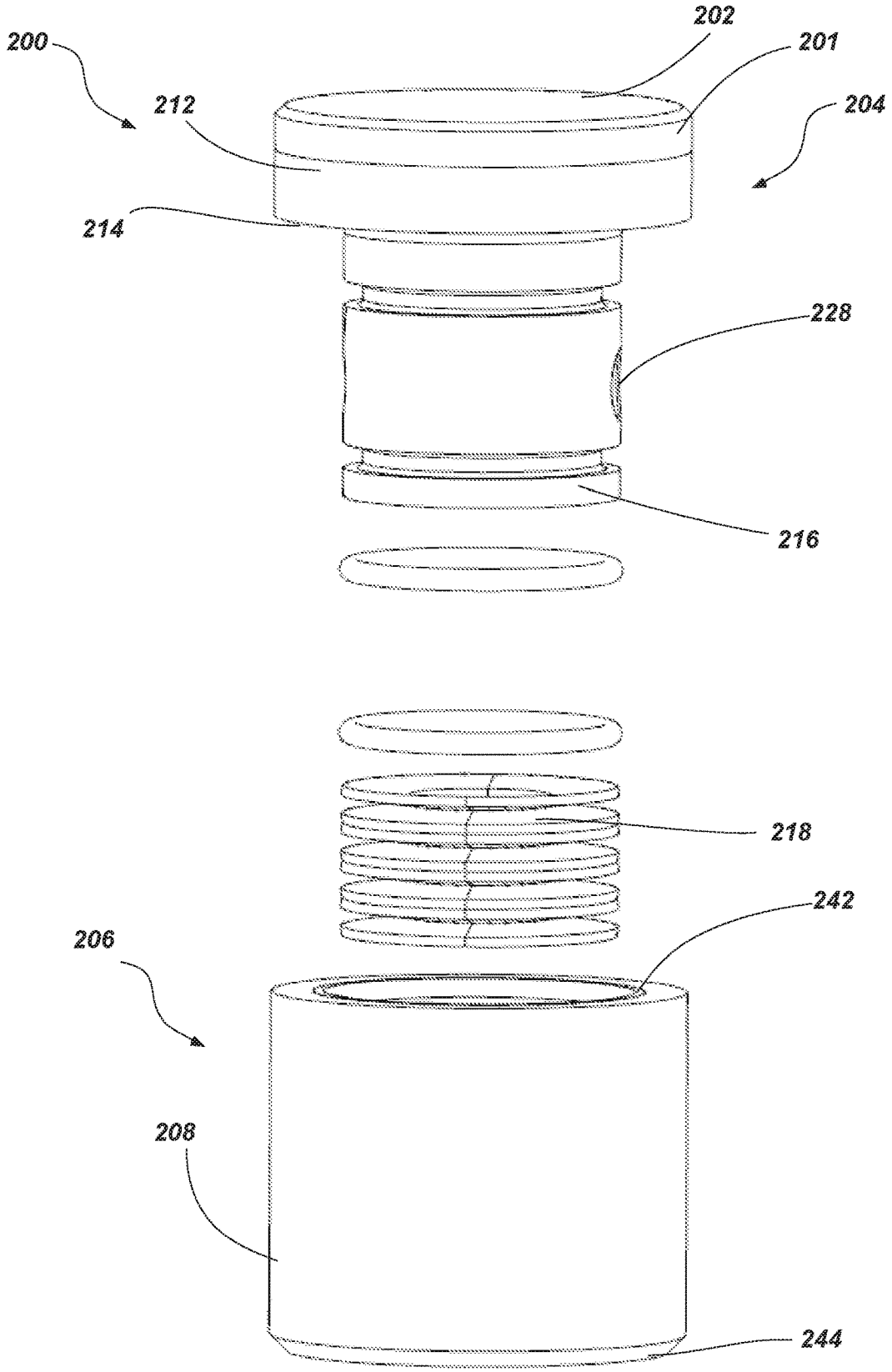
FIG. 7 is an exploded view of the rotatable cutter shown in FIGS. 5 and 6.

FIGS. 6 and 7 are a cross-sectional side view and an exploded view, respectively, of the rotatable cutter 200. The substrate 208 of the rotatable cutter 200 may comprise a rotatable element 204, a sleeve element 242, and an index positioning feature 220.

The rotatable element 204 may include the cutting table 201 with the cutting surface 202 that is configured to engage a portion of a subterranean borehole over a support structure 212. The cutting table 201 may have a diameter at least as large as the sleeve element 242. The support structure 212 may have a diameter less than an interior diameter of the sleeve element 242 such that the rotatable element 204 may be disposed at least partially within the sleeve element 242. The rotatable element 204 may be configured with a shoulder 214 for additional support of the cutting table 201 when the cutting table 201 is engaging a portion of the subterranean borehole. The rotatable element 204 may be configured to move relative to the sleeve element 242 between a first axial position and a second axial position along a longitudinal axis L200 of the rotatable cutter 200. A motivating element 218 may be interposed between a base 216 of the rotatable element 204 and an assembly base 244. As discussed above, the motivating element 218 may bias the rotatable element 204 in an axial position (e.g., in a position where the rotatable element 204 is spaced from one or more of the sleeve element 242 and a stationary element 206.

In some embodiments, the sleeve element 242 may act as the stationary element 206. In other embodiments, the sleeve element 242 may be an additional feature fixed to or integrally formed with the stationary element 206 as shown in FIG. 6. The sleeve element 206 may provide an area to facilitate the index positioning feature 220.

Similar to the embodiment of the rotatable cutting element 100 described above, the index positioning feature 220 may be defined between the rotatable element 204 and the sleeve element 242. The index positioning feature 220 may be configured to rotate the rotatable element 204 relative to the sleeve element 242 when the rotatable element 204 is moved from the first axial position toward the second axial position and when the rotatable element 204 is moved from the second axial position toward the first axial position. When the cutting table 201 is engaged with a portion of the subterranean borehole, the rotatable element 204 may be in the first axial position (e.g., a compressed position somewhat similar to that shown in FIG. 3A). When the cutting table 201 is disengaged from the subterranean borehole, the motivating element 218 may act on the base 216 to move the rotatable element 204 from the first axial position to the second axial position (e.g., to an expanded position somewhat similar to that shown in FIG. 3B).

In some embodiments, one or more protrusions (e.g., pins 222) may be positioned on the support structure 212 of the rotatable element 204 and at least one track 224 may be defined on the stationary element 206 or the sleeve element 242 as shown in FIG. 6. The interaction between the pin 222 and the track 224 may cause the rotatable element 204 to rotate and/or limit (e.g., at least partially or entirely prevent) the rotatable element 204 from rotating.

In some embodiments, the support structure 212 of the rotatable element 204 may include one or more pin passages 228 as shown in FIGS. 6 and 7. The pin 222 may be at least partially disposed within the pin passage 228 in the support structure 212 of the rotatable element 204. In some embodiments, such as the embodiment shown in FIG. 6, there may be two pins 222 that interact with the track 224 on opposite sides of the rotatable element 204. In some embodiments, there may be a biasing member 246 (e.g., a spring) located within the pin passage 228 that allows the pin 222 to be disposed (e.g., forced) entirely within the rotatable element 204 during assembly. The biasing member 246 may contact a pin shoulder 230 forcing a pin tip 232 out of the pin passage 228 and into the track 224 after assembly or during disassembly.

At least one pin 222 may be retained in the track 224. The track 224 may be disposed within one or more of the stationary element 206 and the sleeve element 242. The track 224 may be configured similar to the embodiment of the rotatable cutting element 100 described in FIG. 4 with a top track and a bottom track utilizing detents and ramps to interact with the at least one pin 222. However, as depicted, the track 224 is positioned on the outer component (e.g., the sleeve element 242) rather than an inner element (e.g., the rotatable element 204) as shown in FIG. 4. The respective ramps may be configured to impart rotation on the rotatable element 204 when the rotatable element 204 slides between the first axial position and the second axial position, and the respective detents may be configured to stop rotation when the rotatable element 204 is in the first axial position or the second axial position.

Embodiments of rotatable cutters described herein may improve the wear characteristics on the cutting elements of the rotatable cutters. Rotating the cutters with an index positioning feature that enables positive, incremental rotation of the cutter may allow for tighter control of the rotation of the rotatable cutter that may ensure more even wear on the cutting surface.

Embodiments of the disclosure may be particularly useful in providing a cutting element with improved wear characteristics of a cutting surface that may result in a longer service life for the rotatable cutting elements. Extending the life of the rotatable cutting elements may, in turn, extend the life of the earth-boring tool to which they are attached. Replacing earth-boring tools or even tripping out an earth-boring tool to replace worn or damaged cutters is a large expense for earth-boring operations. Often earth-boring tools are on a distal end of a drill string that can be in excess of 40,000 feet long. The entire drill string must be removed from the borehole to replace the earth-boring tool or damaged cutters. Extending the life of the earth-boring tool may result in significant cost savings for the operators of an earth-boring operation.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A rotatable cutter for use on an earth-boring tool in a subterranean borehole, comprising:

a rotatable element comprising a cutting surface over a support structure; and a stationary element comprising:

a sleeve defining a cavity, the rotatable element disposed at least partially within the cavity, the rotatable element configured to move relative to the sleeve between a first axial position and a second axial position along a longitudinal axis of the rotatable cutter; and an index positioning feature positioned laterally between the rotatable element and the sleeve, the index positioning feature comprising at least one protrusion and at least one track, wherein engagement of the at least one protrusion in the at least one track is configured to rotate the rotatable element relative to the sleeve when the rotatable element is moved toward the second axial position.

2. The rotatable cutter of claim 1, further comprising a motivating element interposed between the stationary element and the rotatable element configured to move the rotatable element between the first axial position and the second axial position.

3. The rotatable cutter of claim 1, wherein interaction between the at least one protrusion and the at least one track is configured to impart rotation on the rotatable element when the rotatable element moves between the first axial position and the second axial position, and wherein the at least one track is configured to substantially inhibit rotation of the rotatable element when the rotatable element is in at least one of the first axial position or the second axial position.

4. The rotatable cutter of claim 1, wherein the at least one protrusion comprises at least two pins arranged about the longitudinal axis.

5. The rotatable cutter of claim 1, wherein the at least one protrusion is positioned on the support structure of the rotatable element and the at least one track is defined on the stationary element.

6. The rotatable cutter of claim 1, wherein the at least one protrusion is positioned on the sleeve and the at least one track is defined on the support structure of the rotatable element.

7. The rotatable cutter of claim 1, wherein interaction between the at least one protrusion and the at least one track is configured to impart rotation on the rotatable element when the rotatable element moves from the first axial position to the second axial position and when the rotatable element moves from the second axial position to the first axial position.

8. The rotatable cutter of claim 7, wherein interaction between the at least one protrusion and the at least one track is configured to at least partially inhibit rotation of the rotatable element when the rotatable element is in both the first axial position and the second axial position.

9. The rotatable cutter of claim 1, wherein rotation of the rotatable element by the index positioning feature is configured to incrementally rotate the cutting surface of the rotatable cutter relative to an earth-boring tool on which the rotatable cutter is attached.

10. The rotatable cutter of claim 9, wherein the index positioning feature is configured to incrementally rotate the cutting surface a first portion of a desired interval when the rotatable element moves from the first axial position to the second axial position, and a second portion of the desired interval when the rotatable element moves from the second axial position to the first axial position, where the first portion is smaller than the second portion.

11. The rotatable cutter of claim 1, wherein the rotatable element is associated with a biasing element, where the biasing element is configured to bias the rotatable element in the first axial position in a direction away from the stationary element.

12. An earth-boring tool, comprising:

a tool body; and elements carried by the tool body, at least one element of the elements comprising:

a movable element comprising a surface configured to engage a portion of a subterranean borehole;

a sleeve element coupled to the movable element, the movable element configured to move relative to the sleeve element between a first axial position and a second axial position along a longitudinal axis of the movable element; and an index positioning feature defined between the movable element and the sleeve element, the index positioning feature configured to rotate the movable element relative to the sleeve element when the movable element is moved from the first axial position toward the second axial position and when the movable element is moved from the second axial position toward the first axial position.

13. The earth-boring tool of claim 12, wherein the index positioning feature further comprises at least one protrusion and at least one track, wherein the interaction between the at least one protrusion and the at least one track is configured to at least partially inhibit rotation of the movable element when the movable element is in both the first axial position and the second axial position.

14. The earth-boring tool of claim 12, wherein the index positioning feature further comprises at least one pin retained in a track, the track configured to impart rotation on the movable element when the movable element slides between the first axial position and the second axial position the track being configured to stop rotation when the movable element is in the first axial position or the second axial position.

15. The earth-boring tool of claim 12, wherein the index positioning feature comprises at least one pin disposed within a support structure of the movable element and at least one track disposed within the stationary element.

16. The earth-boring tool of claim 12, wherein the index positioning feature comprises at least one pin disposed within the stationary element and at least one track disposed within the support structure of the movable element.

17. A method of reorienting a cutting face of a cutting element on an earth-boring tool for use in a subterranean borehole, the method comprising:

translating an inner cutting element component comprising a cutting face and at least partially disposed in an outer sleeve between a first axial position and a second axial position along a longitudinal axis of the cutting element;

rotating the inner cutting element component with an index positioning feature as the inner cutting element component is translated between the first axial position and the second axial position; and at least partially impeding rotation of the inner cutting element component when the inner cutting element component is in at least one of the first axial position or the second axial position with the index positioning feature.

18. The method of claim 17, further comprising biasing the inner cutting element component toward the first axial position with a biasing element.

19. The method of claim 17, wherein rotating the inner cutting element component with the index positioning feature comprises turning the inner cutting element component in response to travel of at least one pin through a track of the index positioning feature.

20. The method of claim 19, wherein at least partially impeding rotation of the inner cutting element component comprises at least partially preventing travel of the at least one pin in the track of the index positioning feature.

* * * * *